US009066411B2

(12) United States Patent
Hui

(10) Patent No.: US 9,066,411 B2
(45) Date of Patent: Jun. 23, 2015

(54) DIMMER SYSTEM AND METHOD

(76) Inventor: Wing Hong Hui, Singapore (SG)

( * ) Notice: Subject to any disclaimer, the term of this patent is extended or adjusted under 35 U.S.C. 154(b) by 734 days.

(21) Appl. No.: 13/261,049

(22) PCT Filed: Sep. 11, 2009

(86) PCT No.: PCT/SG2009/000325

§ 371 (c)(1),
(2), (4) Date: Mar. 1, 2012

(87) PCT Pub. No.: WO2010/138079

PCT Pub. Date: Dec. 2, 2010

(65) Prior Publication Data

US 2012/0153843 A1 Jun. 21, 2012

(30) Foreign Application Priority Data

May 29, 2009 (SG) ..... 200903706-0

(51) Int. Cl.
*H05B 41/38* (2006.01)
*H05B 41/295* (2006.01)
*H05B 41/392* (2006.01)

(52) U.S. Cl.
CPC ..... *H05B 41/295* (2013.01); *H05B 41/3924* (2013.01)

(58) Field of Classification Search
CPC ..... H05B 37/02
USPC ..... 315/56, 58, 59, 60, 62–63, 291, 307, 315/DIG. 4, 158–159, 51, 54, 55
See application file for complete search history.

(56) References Cited

U.S. PATENT DOCUMENTS 6,069,457 A 5/2000 Bogdan
6,137,240 A 10/2000 Bogdan
7,154,231 B2 12/2006 Chou et al.

FOREIGN PATENT DOCUMENTS

KR 10-2008-0047705 5/2008

*Primary Examiner* — Minh D A
(74) *Attorney, Agent, or Firm* — Axis Intellectual Capital; Leif R. Sloan; Sonya C. Harris

(57) ABSTRACT

An exemplary embodiment of the invention, a dimmer system and a dimming method employed thereby, is described. The dimmer system communicates AC power having alternating AC current half-cycles to a gas discharge lamp for energizing the gas discharge lamp. The AC current half-cycles being communicated to the gas discharge lamp is switchable between a first waveform and a second waveform of different amplitudes. By varying the point whereat the switching occurs, illumination intensity of the gas discharge lamp is varied to thereby effect stepless dimming of the gas discharge lamp.

35 Claims, 9 Drawing Sheets

DIMMER SYSTEM AND METHOD

FIELD OF INVENTION

The present invention relates generally to dimmer system and a dimming method for stepless dimming of a gas discharge lamp.

BACKGROUND

Conventional dimmers for operating magnetically ballasted discharge lamps typically utilise an approach of applying of phase control to AC line voltage. Equipment or circuitries incorporating this approach often couples a triac, or paired silicon controlled rectifier (SCR), in series with a lighting fixture. By delaying switching on of a switch at a phase angle from the zero crossing of the AC line voltage, AC power communicated to the lighting fixture is increased or decreased to thereby control intensity of a discharge lamp. FIG. 1 shows exemplary AC current half-cycles across the discharge lamp when phase control is applied by a typical dimmer system to the AC power communicated thereto.

The main problem associated with the phase control approach for varying the AC power communicated to the discharge lamp is that this often results in occurrence of flicker when the AC power communicated to the discharge lamp is reduced during dimming. This becomes progressively worse as AC power level drops below 70% and discontinuity in AC current across the gas discharge lamp increases. The discontinuity in the AC current across the discharge lamp can lead even to the gas discharge lamp being extinguished.

Therefore, there exists a need for an improved dimmer and an improved dimming method.

SUMMARY

In accordance with a first aspect of the invention, there is disclosed a lamp control system comprising a control module and a dimmer module. The control module is for inter-coupling an electrical energy source and a gas discharge lamp with the electrical energy source for providing AC power having alternating AC current half-cycles communicable by the control module to the gas discharge lamp for energizing the gas discharge lamp. The control module is for switching the AC current half-cycles being communicated to the gas discharge lamp between a first waveform and a second waveform with the amplitude of the first waveform being different from the amplitude of the second waveform. The time-point within each of the AC current half-cycle determining illumination intensity of the gas discharge lamp during energising thereof. The dimmer module is for providing control signals to the control module. The time-point within each of the AC current half-cycles is variable by the control signals to thereby vary the illumination intensity of the gas discharge lamp.

In accordance with a second aspect of the invention, there is disclosed a dimming method comprising communicating AC power providable by an electrical energy source to a gas discharge lamp for energizing the gas discharge lamp. The AC power is communicated by a control module with the communicated AC power having alternating AC current half-cycles. The dimming method further comprises switching the AC current half-cycles being communicated to the gas discharge lamp between a first waveform and a second waveform at a time-point by the control module with the amplitude of the first waveform being different from the amplitude of the second waveform and the time-point within each of the AC current half-cycle determining illumination intensity of the gas discharge lamp during energising thereof. The dimming method further comprises varying the time-point within each of the AC current half-cycles to thereby vary the illumination intensity of the gas discharge lamp with the time-point being determined by control signals providable to the control module by a dimmer module.

In accordance with a third aspect of the invention, there is disclosed a machine-readable medium having stored therein a plurality of programming instructions executable by a machine, the instructions, when executed, cause the machine to: communicate AC power providable by an electrical energy source to a gas discharge lamp for energizing the gas discharge lamp, the AC power being communicated by a control module, the communicated AC power having alternating AC current half-cycles; switch the AC current half-cycles being communicated to the gas discharge lamp between a first waveform and a second waveform at a time-point by the control module, the amplitude of the first waveform being different from the amplitude of the second waveform, the time-point within each of the AC current half-cycle determining illumination intensity of the gas discharge lamp during energising thereof; and vary the time-point within each of the AC current half-cycles to thereby vary the illumination intensity of the gas discharge lamp, the time-point being determined by control signals providable to the control module by a dimmer module.

DETAILED DESCRIPTION

Figure 1:
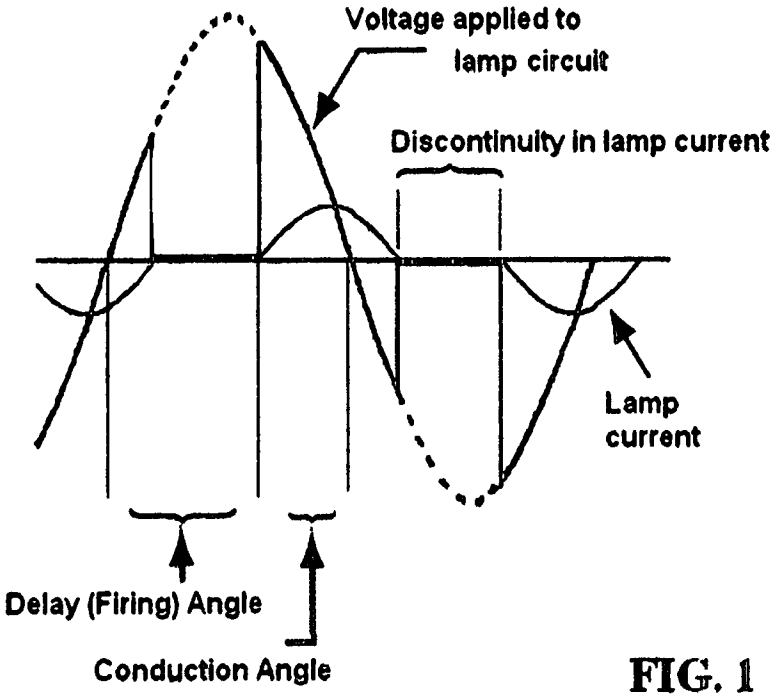
FIG. 1 shows exemplary AC current half-cycles across a discharge lamp when phase control is applied by a typical dimmer system to the AC power communicated thereto.
Figure 2:
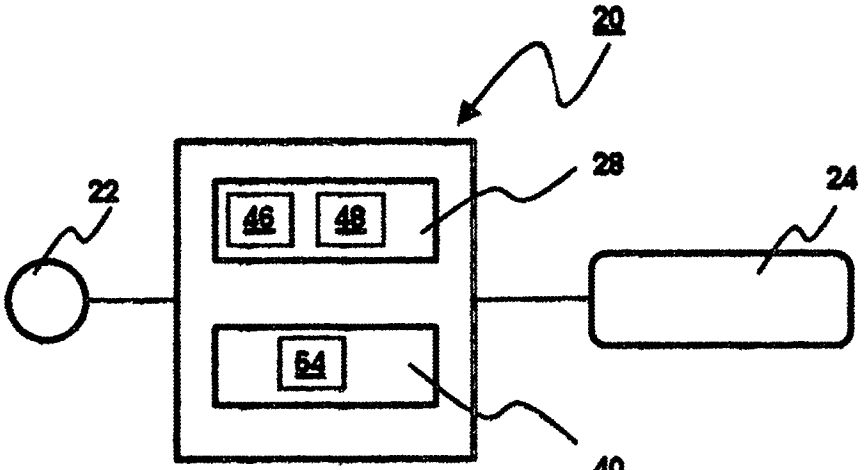
FIG. 2 shows a system diagram of a dimmer system according to an exemplary embodiment of the invention.
Figure 3:
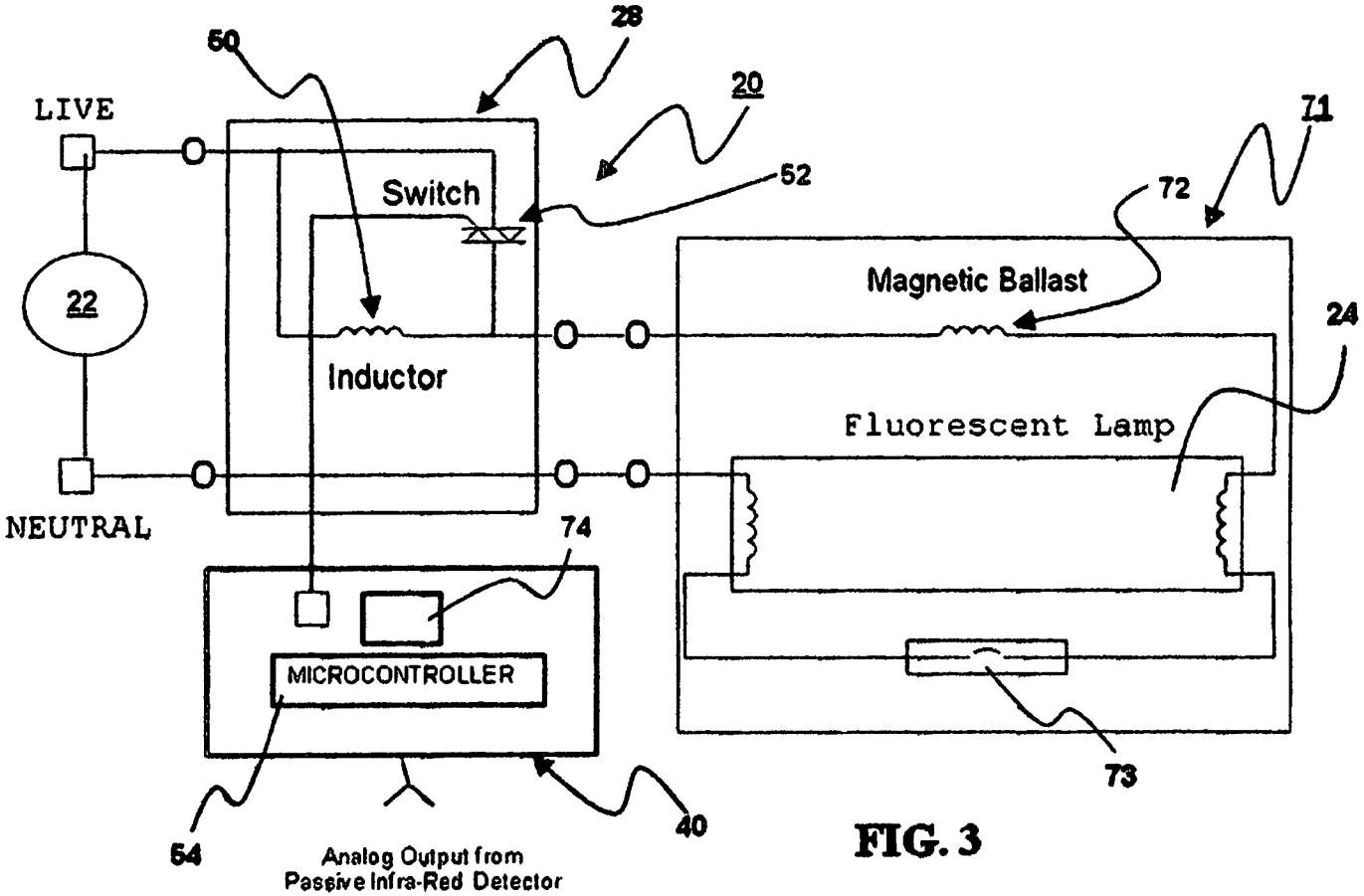
FIG. 3 shows a partial schematic diagram of the dimmer system of FIG. 2 for providing stepless dimming of a gas discharge lamp according to the exemplary embodiment of the invention.
Figure 4:
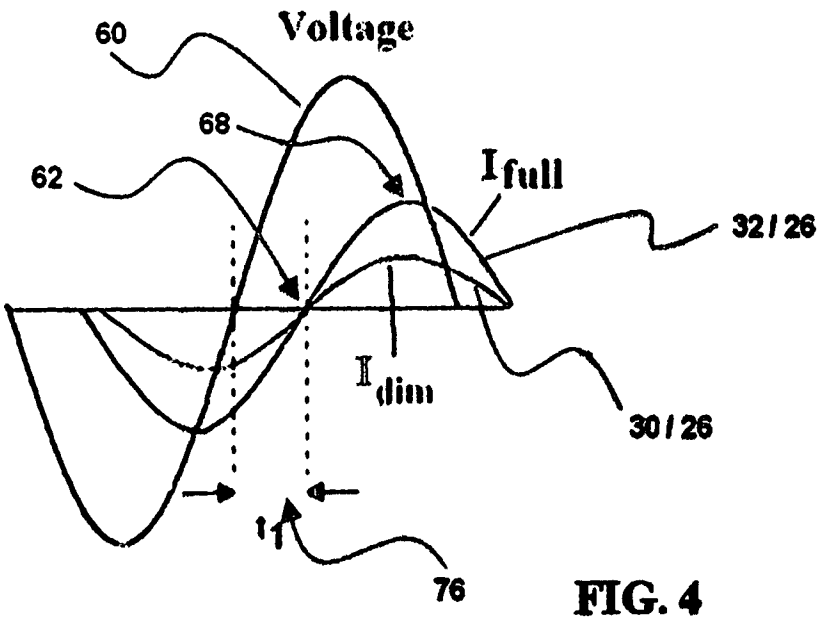
FIG. 4 illustrates AC voltage half-cycles, AC current half-cycles having a first profile and a second profile applied by the dimmer system of FIG. 3 for controlling illumination intensity of the gas discharge lamp.

An exemplary embodiment of the present invention, a dimmer system 20 and a dimming method 200, is described hereinafter with reference to FIG. 1, FIG. 2, FIG. 3, FIG. 4, FIGS. 5*a*-5*b* and FIG. 6.

For purposes of brevity and clarity, the description of the present invention is limited hereinafter to applications relating to gas discharge lamps. This however does not preclude various embodiments of the present invention from other applications where fundamental principles prevalent among the various embodiments of the invention such as operational, functional or performance characteristics are required.

The dimmer system 20 is preferably for inter-coupling an electrical energy source 22 and a gas discharge lamp 24. The electrical energy source 22 is for providing alternating AC current half cycles 26. The dimmer system 20 comprises a control module 28 for communicating the AC power to the gas discharge lamp 24 for energizing the gas discharge lamp 24. The control module 28 is for switching the AC current half-cycles 26 communicated to the gas discharge lamp 24 between a first waveform 30 and a second waveform 32. The switch of the AC current half-cycles 26 between the first waveform 30 and the second waveform 32 is initiated by the control module 28 at a time-point 34 within each of the AC current half-cycles 26. The first waveform 30 and the second waveform 32 define a first amplitude and a second amplitude respectively. Preferably, the first amplitude is different from the second amplitude.

The dimmer system 20 further comprises a dimmer module 40 in signal communication with the control module 28. The time-point 34 within each of the AC current half-cycles is determined by the dimmer module 40 and communicated to the control module 28 via control signals 42. Therefore, the dimmer module 40 is operable for varying the time-point 34 which consequently varies the illumination intensity 44 of the gas discharge lamp 24 when being energized by the AC power.

Preferably, the control module 28 comprises an inducting circuit 46 and a switch 48 coupled parallel the inducting circuit 46. Preferably, the inducting circuit 46 comprises an inductor 50 and the switch 48 comprises a triac 52. In will be apparent to a person skilled in the art in light of this description of the exemplary embodiment of the invention that multiple inductors may be used for replacing the single inductor 50 and the multiple triacs may be used to replace the single triac 52 without substantially changing the function of the inducting circuit 46 and the switch 48. Additionally, a person skilled in the art, in light of the above description, is aware that the triac 52 is replaceable with a relay or the like switches.

Preferably, the dimmer module 40 comprises a microprocessor 54 or the like controllers. Preferably, the microprocessor 54 is electrically coupled to the triac 52 for providing the control signals 42 thereto. Alternatively, the microprocessor 54 is signal coupled via wireless means to the triac 52 for providing the control signals 42 thereto. The use of the microprocessor 54 is preferred as it enables precise control and firing of the triac 52 to be achieved.

Preferably, the control module 28 operates between a first state and a second state. In the first state, the triac 52 is operated to impede passage of the AC power thereacross. In the second state, the triac 54 is operated to substantially enable passage of the AC power thereacross.

In the first state, the AC power is provided from the electrical energy source 22 to the gas discharge lamp 24 across the inductor 50. Although the AC current half-cycles 26 of the AC power is provided with the second waveform 32 at the electrical energy source 22, the inductor 50 modifies the AC current half-cycles 26 into the first waveform 30 when the control module 28 is operating in the first state. This effectively reduces the AC current half-cycles 26 from the second amplitude to the first amplitude, which in turn, reduces current level of the AC power provided to the gas discharge lamp 24.

In the second state, the AC power is provided from the electrical energy source 22 to the gas discharge lamp 24 across the triac 52. This enables the AC current half-cycles 26 of the AC power provided with the second waveform 32 at the electrical energy source 22 to be conveyed to the gas discharge lamp 24 with bias substantially towards the second waveform 32. This in turn enables the maintaining of the AC current half-cycles at substantially the second amplitude which in consequently maintains the current level of the AC power provided to the gas discharge lamp 24 at substantially the same current level of the AC power at the electric energy source 22.

During operations of the dimmer system 20, the dimmer module 40 is operable for varying the time-point 34 within each AC current half-cycles 26. The AC power provided by the electrical energy source 22 further comprises AC voltage half-cycles 60. Based on components used in the dimmer system 20, initiation point 62 of each of the AC current half-cycles 26 is pre-determinable. This enables the microprocessor to ensure that the time-point 34 is within each of the AC current half-cycles 26.

When the time-point 34 coincides with the initiation point 62, the control module operates substantially in the second state within each of the AC current half-cycles 26. Therefore, the AC current half-cycles 26 of the AC power received at the gas discharge lamp 24 will have a lamp waveform 64 that is substantially the second waveform 32. When the gas discharge lamp waveform 64 is substantially the second waveform 32, the illumination intensity of the gas discharge lamp 24 is at an upper intensity limit.

When the time-point 34 coincides with whereat each of the AC current half-cycles 26 peaks 68, the control module operates substantially in the first state within each of the AC current half-cycles 26. Therefore, the gas discharge lamp waveform 64 of the AC current half-cycles 26 of the AC power received at the gas discharge lamp 24 is substantially the first waveform 30. When the gas discharge lamp waveform 64 is substantially the first waveform 32, the illumination intensity of the discharge lamp 24 is at a lower intensity limit 68.

When the time-point 34 occurs between the initiation point 62 and where each of the AC current half cycles 26 peaks 68, the gas discharge lamp waveform 64 of the AC current half-cycles 26 of the AC power received at the gas discharge lamp 24 will be a hybrid between the first waveform 30 and the second waveform 32.

The gas discharge lamp 24 is preferably a constituent of a lighting system 71 whereto the dimmer system 20 is couplable for coupling with the gas discharge lamp 24. The lighting system 71 comprises a ballast 72 and a starter circuit 73. Each of the ballast 72 and the starter circuit is one of structurally integral with and structurally displaced from the gas discharge lamp 24.

Preferably, the ballast 72 interfaces the dimmer system 20 and the gas discharge lamp 24. Preferably, the starter circuit 73 is coupled across the gas discharge lamp 24 for initiating energizing of the gas discharge lamp 24. Hence, the first amplitude of the AC current half-cycles 26 for setting the lower intensity limit is also influenced by the ballast 72. The ballast 72 is preferably a magnetic ballast while the gas discharge lamp 24 is a fluorescent lamp. However, a person skilled in the art will know from the teaching of the foregoing description that other types of ballast and high-pressure lamps may be used for the ballast 72 and gas discharge lamp 24 respectively.

Preferably, the dimmer module 40 further comprises an interface 74 operable by a user for varying the time-point 34 to thereby vary the illumination intensity of the gas discharge lamp 24. The interface 74 is preferably one or a combination of an electromechanical transducer and a digital input panel. In addition, the interface 74 comprises a display or the like indicator (not shown) for indicating a representation of the illumination intensity of the gas discharge lamp 24. Alternatively, the interface 74 is operable via reception of signals from a remote controller, a computer-based system or the like wireless devices. By enabling the illumination intensity of the gas discharge lamp 24 to be controlled by varying the time-point 34 within each of the AC current half-cycles 26 instead of by varying path of current flow within a circuit, the dimmer system 20 is able to achieve stepless control of the illumination intensity to thereby effect stepless dimming of the gas discharge lamp 24 between the upper intensity limit and the lower intensity limit. This in turn translates into cost-effectiveness of the dimmer system 20 which requires only relatively less components to effect stepless dimming when compared with conventional systems and circuitries.

The AC power supplied at the electrical energy source 22 is preferably of 110 volts (V) at 60 hertz (Hz) or 230V at 50 Hz. For control of the triac 52, the relationship between the AC current half-cycles 26 and the AC voltage half-cycles 60 must be pre-established. Due to the inductive nature of the dimmer system 20, the AC current half-cycles 26 phase-lags the AC voltage half-cycles 60 by a phase-delay duration 76 (also referred to as $t_1$). $t_1$ is predictable from the zero crossing of the AC voltage half-cycles 60 and can be accurately programmed into the microprocessor 54. Using a single resistor (not shown), the microprocessor 54 is able to tap the AC current half-cycles 26 for obtaining a stable reference in determining $t_1$, and hence, the initiation point 62 of the AC current half-cycles 26. Thereafter, initiation delay duration 78 (also referred to as $t_{delay}$), and hence the time-point 34, is determinable for generating the illumination intensity at the gas discharge lamp 24.

Figure 5A:
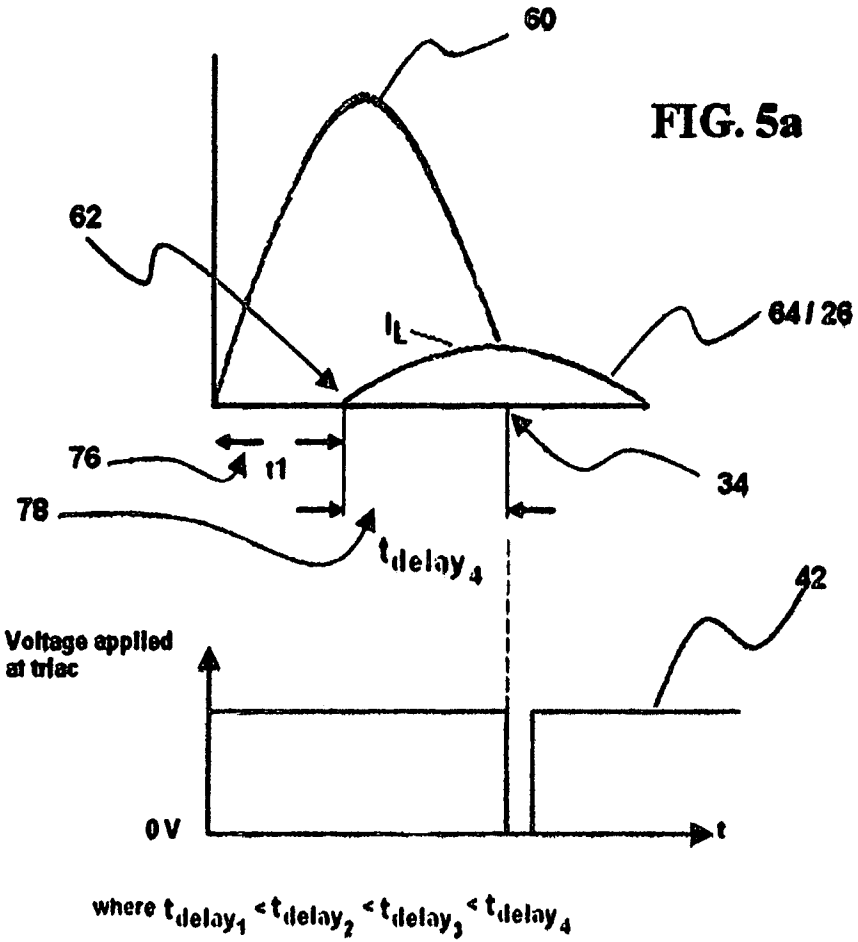
FIGS. 5*a*, 5*b*, 5*c* and 5*d* illustrates lamp waveform of the AC current half-cycles at different time-points for triggering a triac with a control signal.

As aforementioned, the gas discharge lamp waveform 64 is a hybrid or combination of the first waveform 30 and the second waveform 32. When the time-point 34 is substantially at when each of the AC current half-cycles 26 peaks 68, the gas discharge lamp waveform 64 will be substantially the first waveform 30 with a current level of $I_{dim}$ as shown in FIG. 5*a*. $I_{dim}$ establishes the minimum current level that will flow across the inductor 50 and the ballast 72 which leads to the illumination intensity of the gas discharge lamp 24 being at the lower intensity limit.

Figure 5B:
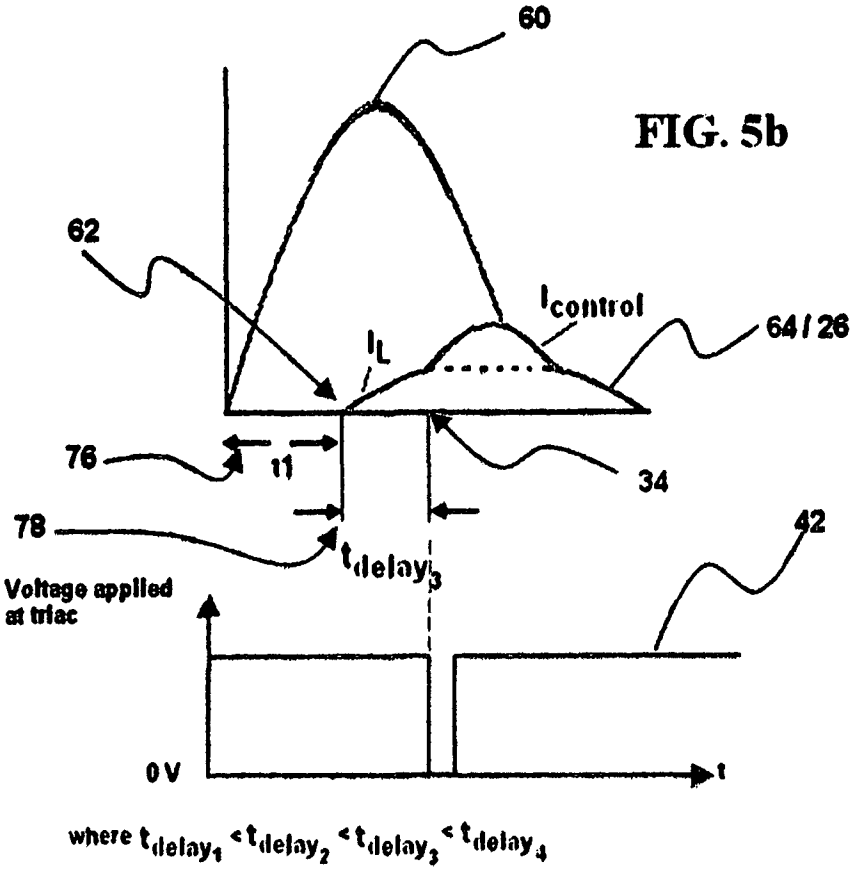
Figure 5C:
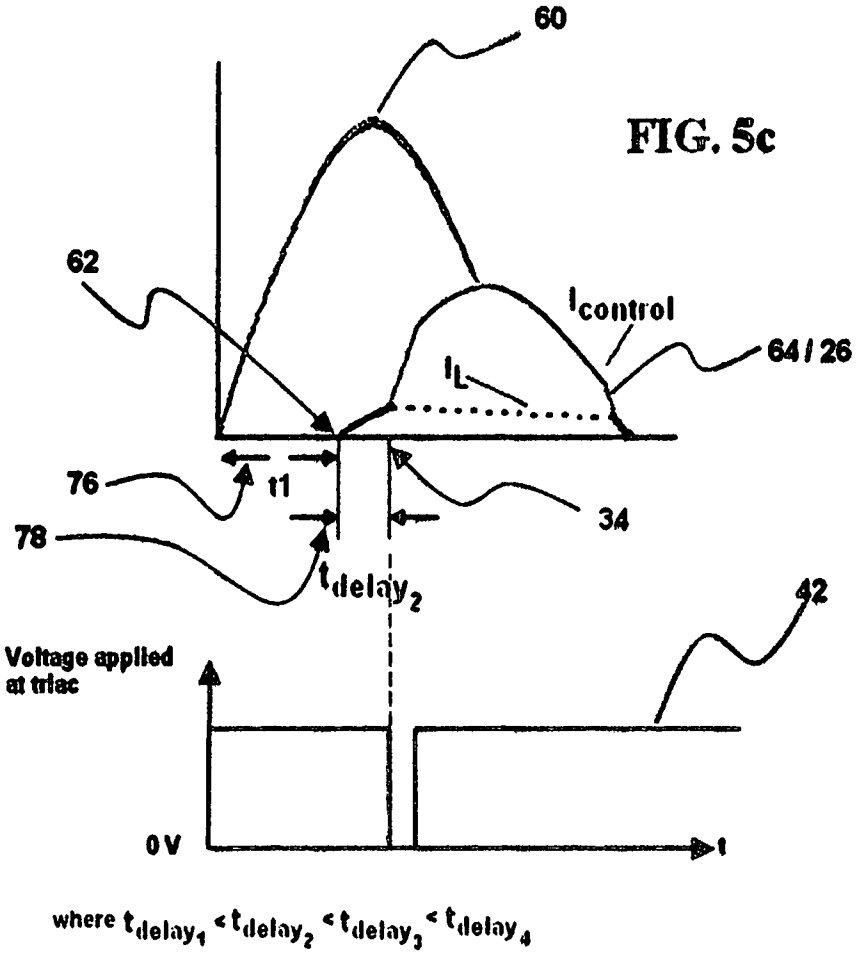

When the time-point 34 moves towards the initiation point 62, portions of second waveform 32 is added to the gas discharge tamp waveform 64 as shown in FIG. 5*b* and FIG. 5*c*. The added portion of the second waveform 32 has a current level of $I_{control}$. Therefore, it is apparent from the foregoing description that the first waveform 30 establishes a base waveform whereto a portion of the second waveform 32 is addable when the time-point is varied 34. Specifically, the current level at the gas discharge lamp 24, $I_{lamp}$ is functionally expressible as $I_{lamp}=I_{dim}+I_{control}$. It is apparent from the gas discharge lamp waveform 64 that there is no discontinuity in the gas discharge lamp current level which affects conventional methods of lamp dimming via phase control. Thus, it is further apparent from the foregoing description that establishing the $I_{dim}$ as a base current enables problems associated with discontinuity of lamp current when applying conventional lamp dimming methods that is present in the prior art method of phase control to be addressed.

Figure 5D:
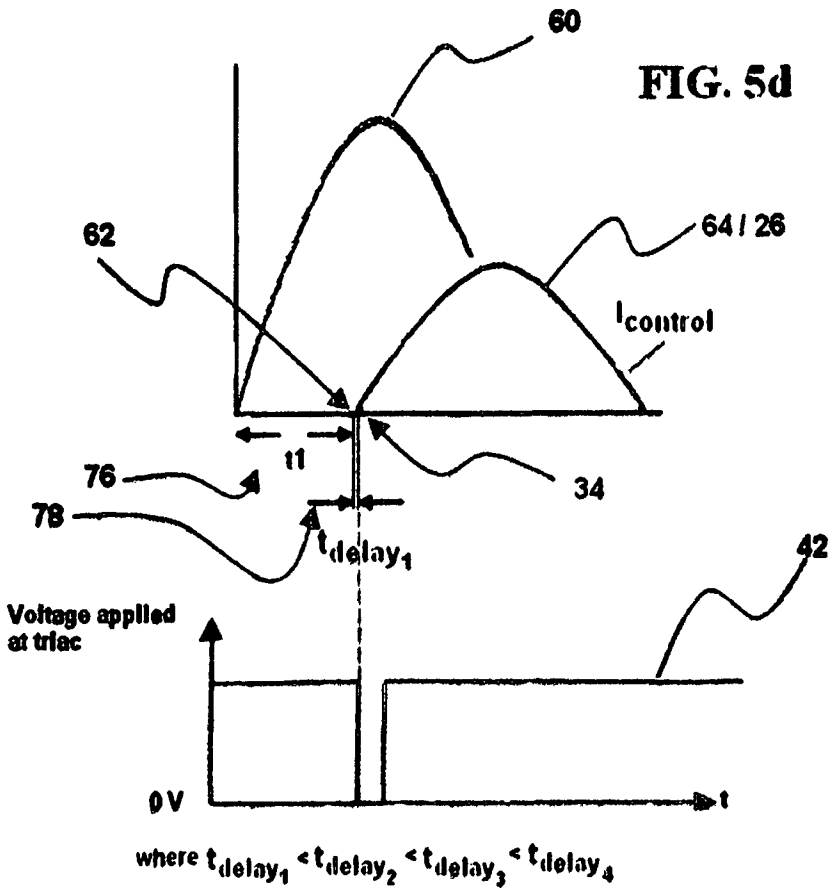

Additionally, when the time-point 34 substantially coincides the initiation point 62 (when $t_{delay}\rightarrow 0$) as shown in FIG. 5*d*, the gas discharge lamp waveform 64 will be substantially be the second waveform 30 with a current level of $I_{full}$. $I_{full}$ is the maximum current level leading to the illumination intensity of the gas discharge lamp 24 being at the upper intensity limit.

The dimmer system 20 and its stepless dimming capabilities have various additional applications. A first additional application is in motion and presence sensing. In the first additional application, the dimmer module 40 further comprises a passive infrared (PIR) circuit in signal communication with the microprocessor 54. The PIR is calibratable for at least one of motion and presence sensing. Preferably, the PIR circuit comprises a pyro-electric transducer and an amplifier stage coupled to the pyro-electric transducer. This enables the microprocessor 54 to control the illumination intensity of the gas discharge lamp 24, based on a control function, in response to at least one of motion and presence sensed.

A second additional application of the dimmer system 20 is in lighting control. In the second additional application, the dimmer module 40 further comprises an ambient light transducer for transducing ambient light intensity into ambient light signals. An ambient light level is determinable from the ambient light signals, which in turn, enables the illumination intensity of the gas discharge lamp 24 to be varied for achieving a preferred level of lighting.

Figure 6:
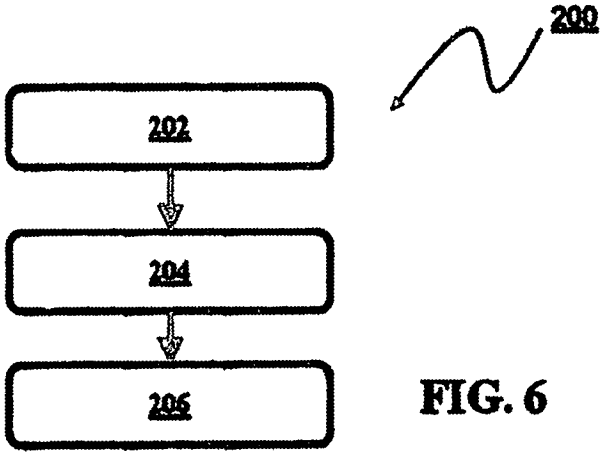
FIG. 6 shows a process flow diagram of a dimming method applied by the dimmer system of FIG. 3 according to the exemplary embodiment of the invention.

The dimmer system 20 implements the dimming method 200 as shown in FIG. 6. The dimming method 200 comprises a step 202 where the AC power providable by the electrical energy source 22 is communicated to the gas discharge lamp 24 for energizing the gas discharge lamp 24. The dimming method 200 further comprises a step 204 of switching the AC current half-cycles 26 being communicated to the gas discharge lamp 24 between the first waveform 30 and the second waveform 32 at the time-point 34 by the control module 28. The dimming method 200 further comprises a step 206 of varying the time-point 34 within each of the AC current half-cycles 26 to thereby vary the illumination intensity of the gas discharge lamp 24.

The steps 202-206 of the dimming method 200 are preferably codable for execution by the microprocessor 54. Alternatively, steps 202-206 of the dimming method 200 are executable by the microprocessor 54 as instruction codes of a program stored in a memory module (not shown) in data communication with the microprocessor 54. Alternatively, the memory module is a storage medium decouplable from the microprocessor 54.

In the foregoing manner, a dimmer system and a dimming method for effecting stepless dimming of a gas discharge lamp is described according to one exemplary embodiments of the present invention. Although only one exemplary embodiment of the present invention is disclosed, it will be apparent to a person skilled in the art in view of this disclosure that numerous changes and/or modifications can be made without departing from the scope and spirit of the present invention.

The invention claimed is:

1. A dimmer system comprising:

a control module for inter-coupling an electrical energy source and a gas discharge lamp, the electrical energy source for providing AC power having alternating AC current half-cycles communicable by the control module to the gas discharge lamp for energizing the gas discharge lamp, the control module for switching the AC current half-cycles being communicated to the gas discharge lamp between a first waveform and a second waveform at a time-point, the amplitude of the first waveform being different from the amplitude of the second waveform, the time-point within each of the AC current half-cycle determining illumination intensity of the gas discharge lamp during energising thereof; and a dimmer module for providing control signals to the control module, the time-point within each of the AC current half-cycles being variable by the control signals to thereby vary the illumination intensity of the gas discharge lamp.

2. The dimmer system as in claim 1, the control module comprising:

an inducting circuit, each of the AC current have-cycles of the AC power providable by the electrical energy source having the second waveform, the inducting circuit for defining the first waveform.

3. The dimmer system as in claim 2, the inducting circuit comprising at least one inductor.

4. The dimmer system as in claim 2, the control module further comprising:

a switch coupled parallel the inducting circuit, the switch operable by the control signals providable by the dimmer module for switching each of the AC current half-cycles between the first waveform and the second waveform.

5. The dimmer system as in claim 4, the switch being one of a triac and a relay.

6. The dimmer system as in claim 1, each of the AC current half-cycles initiating at the first waveform, the amplitude of the first waveform being smaller than the amplitude of the second waveform.

7. The dimmer system as in claim 1, the AC power further having alternating AC voltage half-cycles, phase difference between the AC current half-cycles and the AC voltage half-cycles being pre-defined, the time-point within each of the AC current half-cycles being determined with reference to the phase-difference.

8. The dimmer system as in claim 1, the dimmer module comprising:

a microprocessor for providing the control signals.

9. The dimmer system as in claim 8, the dimmer module further comprising:

a passive infrared (PIR) circuit in signal communication with the microprocessor, the PIR circuit for at least one of motion and presence sensing, the microprocessor for controlling the illumination intensity of the gas discharge lamp based on a control function and in response to the at least one of motion and presence sensed by the PIR circuit.

10. The dimmer system as in claim 9, the PIR circuit comprising:

a pyro-electric transducer; and an amplifier stage coupled to the pyro-electric transducer.

11. The dimmer system as in claim 9, the interface being one of a digital interface and an electro-mechanical interface.

an amplifier stage coupled to the pyro-electric transducer.

12. The dimmer system as in claim 1, the dimmer module comprising:

an interface, the time-point within each of the AC current half-cycles being varied by the control signals in response to the interface being operated.

13. The dimmer system as in claim 1, the gas discharge lamp comprising a ballast.

14. The dimmer system as in claim 1, the illumination intensity of the gas discharge lamp being variable between an upper intensity limit and a lower intensity limit by the control module, the illumination intensity being substantially at the upper intensity limit when the time-point is substantially biased towards start of each AC current half-cycles and the illumination intensity being substantially at the lower intensity limit when the time-point is substantially biased towards the peak of each AC current half-cycles.

15. The dimmer system as in claim 1, the dimmer module comprising:

an ambient light transducer for transducing ambient light intensity into ambient light signals wherefrom ambient light level is determinable, the illumination intensity of the gas discharge lamp being a function of the ambient light level.

16. The dimmer system as in claim 1, the gas discharge lamp being one of a fluorescent lamp and a high pressure lamp.

17. A dimming method comprising:

communicating AC power providable by an electrical energy source to a gas discharge lamp for energizing the gas discharge lamp, the AC power being communicated by a control module, the communicated AC power having alternating AC current half-cycles;

switching the AC current half-cycles being communicated to the gas discharge lamp between a first waveform and a second waveform at a time-point by the control module, the amplitude of the first waveform being different from the amplitude of the second waveform, the time-point within each of the AC current half-cycle determining illumination intensity of the gas discharge lamp during energising thereof; and varying the time-point within each of the AC current half-cycles to thereby vary the illumination intensity of the gas discharge lamp, the time-point being determined by control signals providable to the control module by a dimmer module.

18. The dimming method as in claim 17, the control module comprising:

an inducting circuit, each of the AC current have-cycles of the AC power providable by the electrical energy source having the second waveform, the inducting circuit for defining the first waveform.

19. The dimming method as in claim 18, the control module comprising:

a switch coupled parallel the inducting circuit, the switch operable by the control signals providable by the dimmer module for switching each of the AC current half-cycles between the first waveform and the second waveform.

20. The dimming method as in claim 17, each of the AC current half-cycles initiating at the first waveform, the amplitude of the first waveform being smaller than the amplitude of the second waveform.

21. The dimming method as in claim 17, the AC power further having alternating AC voltage half-cycles, phase difference between the AC current half-cycles and the AC voltage half-cycles being pre-defined, the time-point within each of the AC current half-cycles being determined with reference to the phase-difference.

22. The dimming method as in claim 17, further comprising:

sensing at least one of motion and presence by a passive infrared (PIR) circuit in signal communication with a microprocessor; and controlling the illumination intensity of the gas discharge lamp by the microprocessor based on a control function and in response to the at least one of motion and presence sensed by the PW circuit.

23. The dimming method as in claim 17, the dimmer module comprising:

an interface, the time-point within each of the AC current half-cycles being varied by the control signals in response to the interface being operated.

24. The dimming method as in claim 17, the gas discharge lamp comprising a ballast.

25. The dimming method as in claim 17, the illumination intensity of the gas discharge lamp being variable between an upper intensity limit and a lower intensity limit by the control module, the illumination intensity being substantially at the upper intensity limit when the time-point is substantially biased towards start of each AC current half-cycles and the illumination intensity being substantially at the lower intensity limit when the time-point is substantially biased towards the peak of each AC current half-cycles.

26. The dimming method as in claim 17, the dimmer module comprising:

transducing ambient light intensity into ambient light signals by an ambient light transducer, ambient light level being determinable from the ambient light signals, the illumination intensity of the gas discharge lamp being a function of the ambient light level, the dimmer module comprising the ambient light transducer.

27. The dimming method as in claim 17, the gas discharge lamp being one of a fluorescent lamp and a high pressure lamp.

28. A machine-readable medium having stored therein a plurality of programming instructions executable by a machine, the instructions, when executed, cause the machine to:

communicate AC power providable by an electrical energy source to a gas discharge lamp for energizing the gas discharge lamp, the AC power being communicated by a control module, the communicated AC power having alternating AC current half-cycles;

switch the AC current half-cycles being communicated to the gas discharge lamp between a first waveform and a second waveform at a time-point by the control module, the amplitude of the first waveform being different from the amplitude of the second waveform, the time-point within each of the AC current half-cycle determining illumination intensity of the gas discharge lamp during energising thereof; and vary the time-point within each of the AC current half-cycles to thereby vary the illumination intensity of the gas discharge lamp, the time-point being determined by control signals providable to the control module by a dimmer module.

29. The machine-readable medium as in claim 28, the control module comprising:

an inducting circuit, each of the AC current have-cycles of the AC power providable by the electrical energy source having the second waveform, the inducting circuit for defining the first waveform; and a switch coupled parallel the inducting circuit, the switch operable by the control signals providable by the dimmer module for switching each of the AC current half-cycles between the first waveform and the second waveform.

30. The machine-readable medium as in claim 28, each of the AC current half-cycles initiating at the first waveform, the amplitude of the first waveform being smaller than the amplitude of the second waveform.

31. The machine-readable medium as in claim 28, the AC power further having alternating AC voltage half-cycles, phase difference between the AC current half-cycles and the AC voltage half-cycles being pre-defined, the time-point within each of the AC current half-cycles being determined with reference to the phase-difference.

32. The machine-readable medium as in claim 28, the instructions, when executed, further cause the machine to:

sense at least one of motion and presence by a passive infrared (PIR) circuit in signal communication with a microprocessor; and control the illumination intensity of the gas discharge lamp by the microprocessor based on a control function and in response to the at least one of motion and presence sensed by the PIR circuit.

33. The machine-readable medium as in claim 28, the gas discharge lamp comprising a ballast and being one of a fluorescent lamp and a high pressure lamp.

34. The machine-readable medium as in claim 28, the illumination intensity of the gas discharge lamp being variable between an upper intensity limit and a lower intensity limit by the control module, the illumination intensity being substantially at the upper intensity limit when the time-point is substantially biased towards start of each AC current half-cycles and the illumination intensity being substantially at the lower intensity limit when the time-point is substantially biased towards the peak of each AC current half-cycles.

35. The machine-readable medium as in claim 28, the dimmer module comprising:

transducing ambient light intensity into ambient light signals by an ambient light transducer, ambient light level being determinable from the ambient light signals, the illumination intensity of the gas discharge lamp being a function of the ambient light level, the dimmer module comprising the ambient light transducer.

* * * * *